US006938797B2

(12) United States Patent
Brugner et al.

(10) Patent No.: US 6,938,797 B2
(45) Date of Patent: Sep. 6, 2005

(54) EXPRESSING OR DISPENSING DEVICE FOR A COAXIAL CARTRIDGE

(75) Inventors: Nikolaus Brugner, Ziemetshausen (DE); Rolf Heusser, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 161 days.

(21) Appl. No.: 10/674,063

(22) Filed: Sep. 29, 2003

(65) Prior Publication Data

US 2004/0129122 A1 Jul. 8, 2004

Related U.S. Application Data

(63) Continuation of application No. PCT/EP02/14278, filed on Dec. 14, 2002.

(30) Foreign Application Priority Data

Feb. 20, 2002 (DE) ..... 202 02 6205 U

(51) Int. Cl.[7] ..... B67D 5/52

(52) U.S. Cl. ..... 222/80; 222/129; 222/137; 206/222

(58) Field of Search ..... 222/80, 137, 129; 206/222

(56) References Cited

U.S. PATENT DOCUMENTS 4,493,436 A 1/1985 Brokaw

FOREIGN PATENT DOCUMENTS

| | | |
|---|---|---|
| DE | 36 06 001 A1 | 8/1987 |
| DE | 299 12 888 U1 | 10/1999 |
| DE | 200 11 645 U1 | 11/2000 |
| DE | 199 43 877 A1 | 3/2001 |
| DE | 200 01 438 U1 | 7/2001 |
| FR | 1 468 507 A | 2/1967 |
| FR | 1 470 125 A | 2/1967 |

*Primary Examiner*—Philippe Derakshani
(74) *Attorney, Agent, or Firm*—Martin Fleit; Paul D. Bianco; Fleit Kain Gibbons Gutman Bongini & Bianco P.L.

(57) ABSTRACT

An expressing device for a coaxial cartridge with an outer tube and an inner tube. In order to increase the filling volume of coaxial cartridges that can be expressed with commercially available metering guns, the expressing device is provided with a separating device for severing the inner tube and with a deflecting device for deflecting the one or more severed sections of the inner tube toward the inner wall of the outer tube when the coaxial cartridge is expressed.

19 Claims, 4 Drawing Sheets

EXPRESSING OR DISPENSING DEVICE FOR A COAXIAL CARTRIDGE

RELATED APPLICATION

This application is a continuation of International Patent Application No. PCT/EP02/14278 filed Dec. 14, 2002, the contents of which are herein incorporated in their entirety.

BACKGROUND OF THE INVENTION

1. Field of the Invention

The invention pertains to an expressing or dispensing device for a coaxial cartridge, and to the combination of a coaxial cartridge with a novel expressing device.

2. Prior Art

Coaxial cartridges of the aforementioned type are frequently utilized for storing and processing reactive adhesives, sealing compounds and the like. Such coaxial cartridges usually contain an outer tube and an inner tube that is arranged coaxial to the outer tube, wherein said tubes delimit an inner chamber and an outer chamber for accommodating the different components. However, special expressing rams need to be provided in order to express coaxial cartridges of this type with the broadly utilized and inexpensive standard metering guns for single-component cartridges. Commercially available standard metering guns have a pressure ram that would prevent the contents of the cartridge from being expressed once the ram contacts the inner tube. This is the reason that a specially designed pressure ram needs to be utilized which consists of a central pressure ram and an outer pressure ram in the form of a tube. The disadvantage of this construction can be seen in the fact that the expressing ram occupies approximately half of the space available for accommodation of the cartridge and the expressing ram in a standard metering gun. Consequently, the filling volume of such coaxial cartridges must be limited to half the filling volume of commercially available single-component cartridges.

It has also been proposed to realize the inner tube of a coaxial cartridge in the form of a folding aluminum tube, such that the inner tube is folded up when the coaxial cartridge is expressed with a commercially available metering gun for single-component cartridges. However, this embodiment has the disadvantage that filling with resinous substances and installation of the piston are subject to special requirements. Coaxial cartridges consisting of plastic and metal parts are also not ideal with respect to their disposal.

SUMMARY OF THE INVENTION

The invention is based on the objective of developing an expressing device and a coaxial cartridge of the initially mentioned type which make it possible to increase the filling volume of coaxial cartridges that can be expressed with commercially available metering guns.

This objective is attained with an expressing device with the characteristics to be described, and with a coaxial cartridge with the characteristics to be described. Practical embodiments and advantageous additional developments of the invention are disclosed herein.

According to the invention, the inner tube of a coaxial cartridge is severed by means of a separating device and bent against the inner wall of the outer tube when the coaxial cartridge is expressed. This is realized with a specially designed expressing device that comprises a separating device for severing the inner tube and a deflecting device for deflecting the one or more severed tube section toward the inner wall of the outer tube. This expressing device may be realized in the form of a separate component, or be integrated into the sealing piston of the cartridge.

In one particularly suitable embodiment of the invention, the separating device contains two cutting elements that divide the inner tube into two halves of approximately identical size. However, the separating device may also contain only one, or more than two cutting elements in order to sever the inner tube. For cost reasons, the cutting element preferably consists of a plastic blade that is realized integrally with the injection-molded expressing device. However, the cutting element may also consist of a separate injection-molded plastic blade that is installed in the expressing device. If harder cartridge materials are used, it is also possible to utilize cutting blades of metal. Metal blades are preferably integrated with the injection-molded expressing device in the form of inserts.

The cutting elements are preferably arranged in such a way that they do not cut the inner tube at a right angle relative to the tube wall, but rather obliquely. This makes it possible to reduce the cutting resistance. The cutting blades are preferably arranged at an angle of between 45 and 60° to a tangent to a guide piece of the expressing device that fits into the inner tube.

The deflecting device preferably consists of conical deflection surfaces and/or oblique guide surfaces, by means of which the severed sections of the inner tube are deflected toward lateral slots and are guided past the pressure ram of the metering gun or the like. The deflection surfaces and the lateral slots cause the severed inner tube wall to be bent and pressed against the inner wall of the outer tube. The pressure ram of a conventional metering gun for single-component cartridges consequently has sufficient space to move past the severed and laterally bent inner tube and to press the sealing piston forward by means of the expressing device. The inner part of the expressing device preferably widens continuously from the front guide part that fits into the inner tube to the rear end. This subjects the inner tube to a tensile stress that simplifies the cutting process. For example, V-shaped notches may be provided on the end of the inner tube in order to simplify attachment of the cutting blades.

The expressing device is preferably pre-installed into the coaxial cartridge. For this purpose, the inner tube of the cartridge is preferably shortened by the length of the expressing device such that the expressing device is covered by and guided in the outer tube when expression of the cartridge begins.

It is advantageous to provide centering aids for centrally arranging the pressure ram relative to the expressing device at the end of the expressing device that faces the pressure ram of the metering gun. This ensures that the severed regions of the inner tube are able to glide past the pressure ram.

In another advantageous embodiment, one or more additional deflectors are provided for pressing one end of the one or more severed inner tube sections inward and/or the other ends outward. This causes the sections to congest one another to a lesser degree in the vicinity of the separating point. This also simplifies the cutting process and reduces the cutting resistance.

BRIEF DESCRIPTION OF THE DRAWINGS

Other specifics and advantages of the invention are discussed in the following description of preferred embodiments which refers to the figures in which.

DETAILED DESCRIPTION OF PREFERRED EMBODIMENTS OF THE INVENTION

Figure 1:
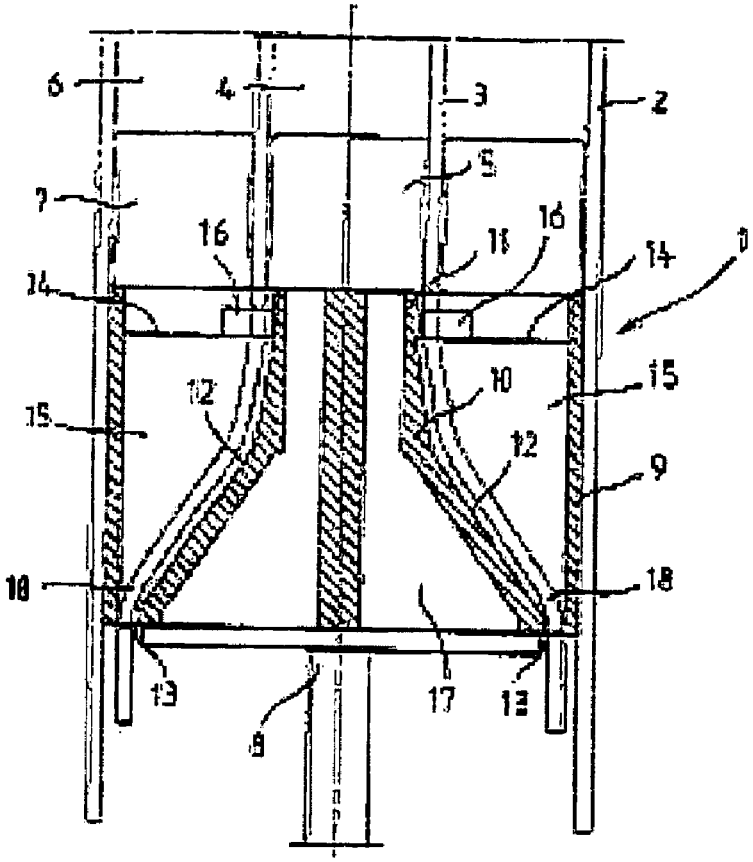
FIG. 1 shows a cross section of part of a two-component coaxial cartridge with a piston, a pressure ram and an expressing device according to the invention.

FIG. 1 schematically shows part of a two-component coaxial cartridge 1 with an outer tube 2 and an inner tube 3 that is arranged concentric to the outer tube. The inner tube 3 forms an inner chamber 4, in which a central inner piston 5 is displaceably arranged. The outer wall of the inner tube 3 and the inner wall of the outer tube 2 delimit between them an outer annular chamber 6 in which an annular outer piston 7 is displaceably arranged. The inner chamber 4 and the outer annular chamber 6 serve to accommodate material components to be distributed, which are expressed from a cartridge outlet opening, not shown, when both pistons 5 and 7 are displaced by the pressure ram 8 of a commercially available metering gun or the like. In the embodiment shown in FIG. 1, an expressing device, described in greater detail below, is arranged between the pistons 5 and 7 on the one hand and the pressure ram 8 on the other.

The expressing device, shown as a cross section in FIG. 1, has the shape of a plunger with a cylindrical outer wall 9 and a conically widening inner part 10. The outside diameter of the outer wall 9 is slightly smaller than the inside diameter of the outer tube 2. The front end of the inner part 10, on the side toward the piston, is provided with a central guide piece 11 that fits into the inner tube 3, and that has an oval cross section in the embodiment shown. Conical deflection surfaces 12 extend from the guide piece 11 to two oppositely arranged outlet slots 13 that are situated in the vicinity of the outer wall 9 at the rear end of the plunger that faces the pressure ram 8. Two oppositely arranged connecting webs, with respective upper edges 14 that are set back relative to the guide piece 11, and with guiding surfaces 15 that are obliquely sloped on both sides, are arranged between the outer wall 9 and the inner part 10. A cutting blade 16, which serves to sever the inner tube 3 and is situated adjacent to the guide piece 11, is arranged on the upper edge 14 of each of the two connecting webs. The inner part 10 is realized in the form of a hollow element with several through-bores 17 that are uniformly spaced apart from one another and have the cross section of a segment of a circle.

According to FIG. 1, the inner tube 3 is severed by the two cutting blades 16 when the expressing device is pressed in by the plunger 8. The severed sections 18 of the inner tube 3 are deflected to the two outlet slots 13 by the guide surfaces 15 and the conical deflection surfaces 12 of the inner part 10, and are guided past the pressure ram 8 via said slots.

Figure 2:
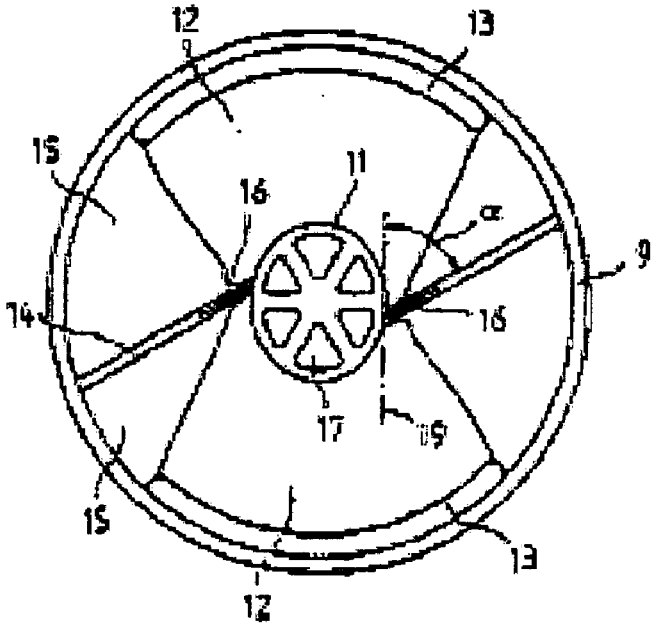
FIG. 2 shows a top view of the part of a second embodiment of an expressing device according to the invention that faces the piston.
Figure 3:
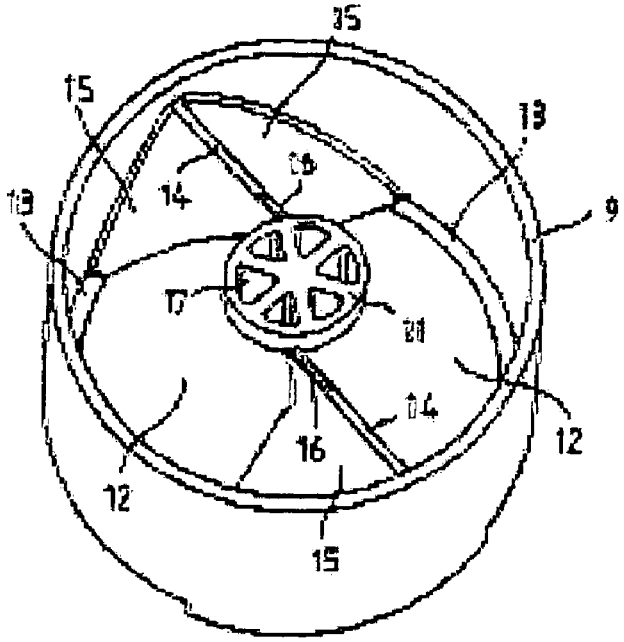
FIG. 3 shows an oblique view of the piston-facing part of the expressing device that is shown in FIG. 2.
Figure 4:
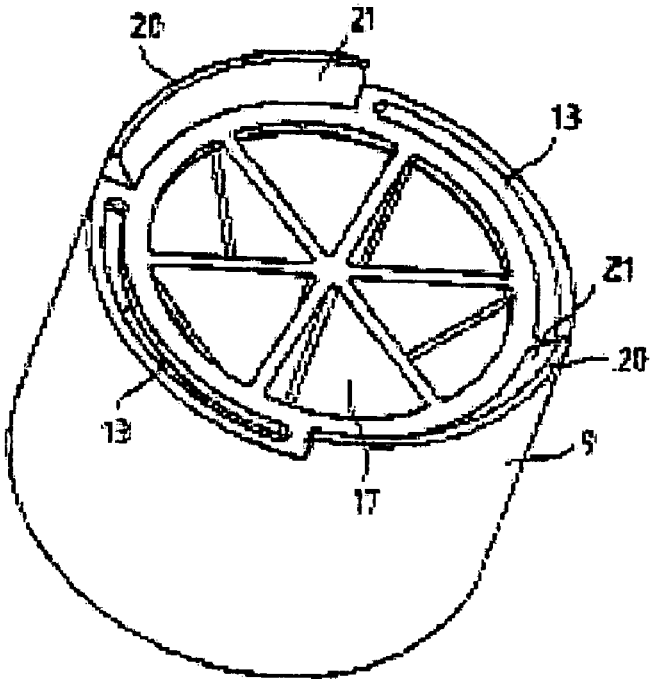
FIG. 4 shows a an oblique view of the pressure-ram-facing part of the expressing device that is shown in FIG. 2.

FIGS. 2–4 show another embodiment of an expressing device. This embodiment differs from the embodiment according to FIG. 1 merely in that the cutting blades 16 are not arranged on a common axis that extends through the center of the guide part 11, but rather are offset parallel to one another at an angle $\alpha$ of less than 90°, preferably between 45 and 60°, relative to a tangent 19 to guide part 11. Corresponding parts are identified by the same reference symbols. In this embodiment, conical deflection surfaces 12 extend from the oval guide part 11 that fits into the inner tube to the outlet slots 13 that are arranged opposite one another at the edge of the outer wall 9. The cutting blades 16 are arranged on the upper edges 14 of two offset connecting webs having transverse or bent guide surfaces 15.

According to FIG. 4, two centering webs 20 that have the shape of a circular arc and are provided with inwardly tapered centering surfaces 21 are arranged on the rear end of the expressing device that faces the pressure ram. The centering webs 20, arranged between the outlets slots 14, cause the pressure ram 8 to be arranged centrally on the expressing device and ensure that the sections 18 can be safely guided past the pressure ram.

Figure 5:
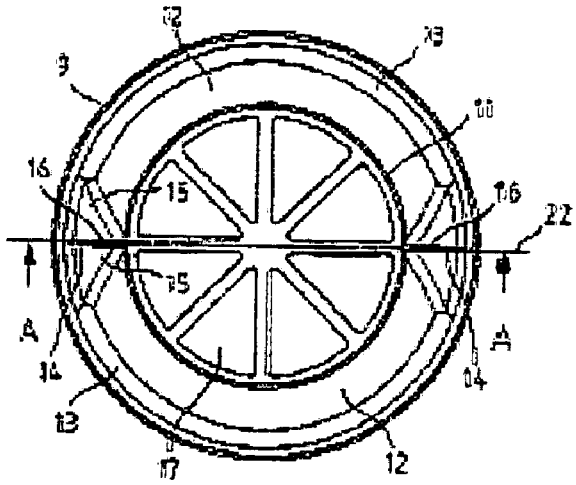
FIG. 5 shows a top view of the piston-facing part of a third embodiment according to the invention.
Figure 6:
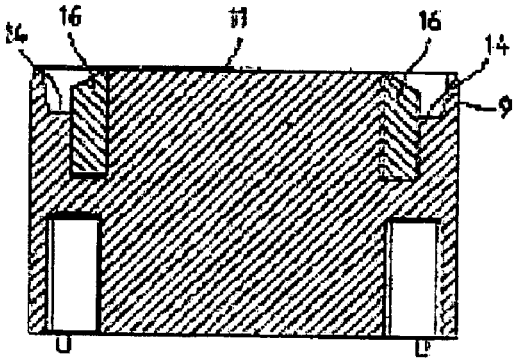
FIG. 6 shows a cross section along line A—A in FIG. 5.
Figure 7:
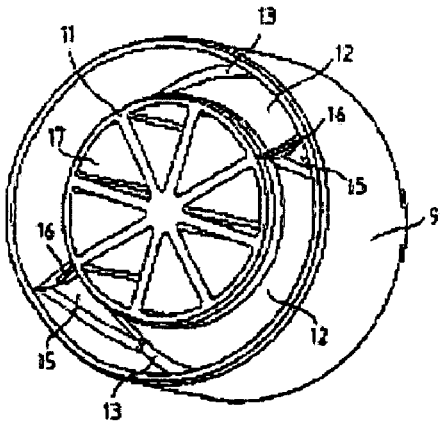
FIG. 7 shows an oblique view of the piston-facing part of a second embodiment of a device for severing the inner tube of a 1:1-coaxial cartridge.

FIGS. 5–7 show another embodiment of an expressing device, designed for a 1:1 two-component coaxial cartridge, in which the inner chamber and the outer chamber have the same volume. In this embodiment, the diameter of the guide piece 11 of circular cross section is adapted to the larger inside diameter of the inner tube. The cutting blades 16 are also arranged on the upper edge 14 of a connecting web between the inner guide part 11 and the outer wall 9 in this case. The sections severed by the cutting blades 16 are deflected to the lateral outlets slots 13 by conical deflection surfaces 12 and bent or transverse guide surfaces 15. In the embodiment shown, the cutting blades 16, which are beveled on the upper side, are arranged diametrically opposite one another on a central axis 22 that extends through the center of the expressing device.

Figure 8:
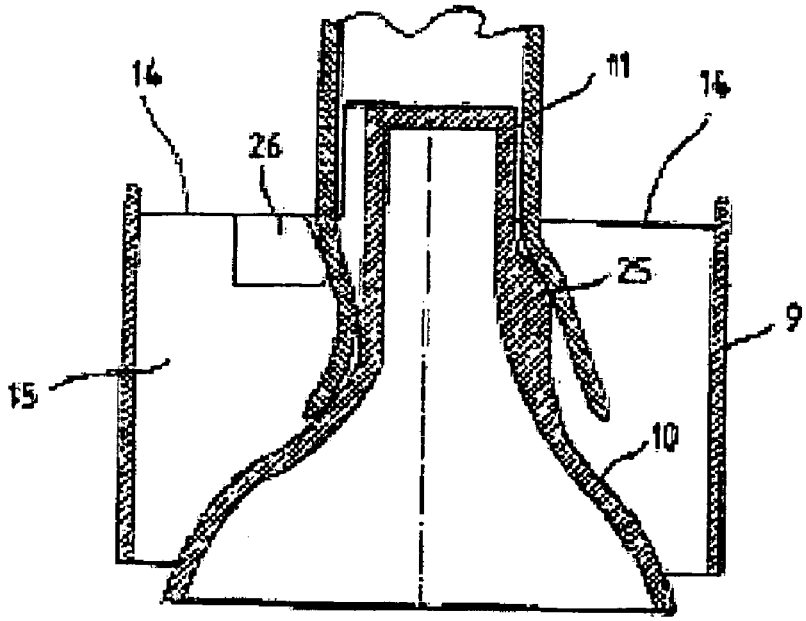
FIG. 8 shows another embodiment of an expressing device, shown as a cross section along line A—A in FIG. 9.
Figure 9:
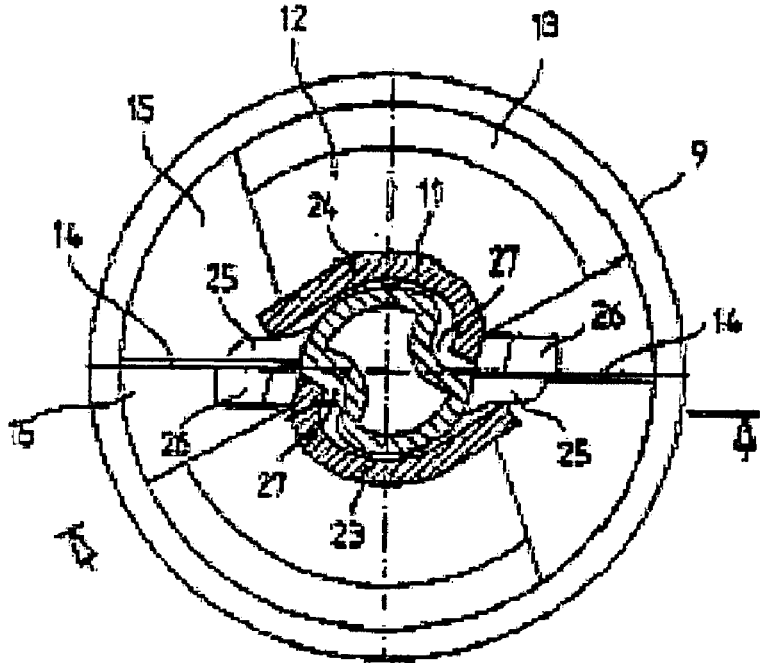
FIG. 9 shows a top view of the piston-facing part of the expressing device according to FIG. 8.

Another embodiment of an expressing device is shown in FIGS. 8 and 9. This expressing device also has a cylindrical outer wall 9 and an inner part 10 that conically widens in the direction of the pressure ram. The inner part 10 comprises a central guide piece 11 that fits into the inner tube 3 of a coaxial cartridge 1, with conical deflection surfaces 12 extending from the central guide piece to two oppositely arranged outlet slots 13. Connecting webs with an upper edge 14 and guide surfaces 15 that are obliquely sloped on both sides are also provided between the outer wall 9 and the inner part 10 in this case. The upper edges 14 are realized in the form of cutting blades and form the separating device for severing the inner tube 3 into two sections 23 and 24. Two first deflectors 25 formed as outwardly protruding projections are integrally formed on the outside of the guide piece 11 beneath the edges 14, and these are arranged diametrically opposite one another and on opposite sides of the edges 14. These deflectors 25 press one end of the severed sections 23 and 24 of the inner tube 3 radially outward in the region of the edge 14. Opposite to first deflectors 25, two deflectors are 26 optionally provided on the other side of the edges 14, by means of which the ends of the respective other wall sections 23 and 24 of inner tube 3 that lie opposite the inwardly or outwardly bent ends are bent radially inward. Recesses 27, which lie diametrically opposite one another and serve to accommodate the inwardly pressed ends of the sections 23 and 24, are provided in the guide piece 11. The ends of the severed sections 23 and 24 are thus pressed apart in the vicinity of the cutting blade, and congest one another to a lesser degree. This simplifies the cutting process and reduces the cutting resistance.

The above-described expressing or dispensing device is preferably realized in the form of an injection-molded part. The cutting blades may consist of plastic blades that are realized integrally with the injection-molded part. However, the cutting blades may also consist of metal and be rigidly molded into the injection-molded part or be replaceable.

The invention is not limited to the previously described and illustrated embodiments. The expressing device can be used for all standard coaxial cartridges, with all volume ratios between the inner chamber and the outer chamber, by choosing the dimensions of the outer wall and the inner part accordingly.

What is claimed is:

1. Expressing device for a coaxial cartridge with an outer tube and an inner tube, characterized by a separating device for severing the inner tube, and by a deflecting device for deflecting the one or more severed sections of the inner tube) toward the inner wall of the outer tube when the coaxial cartridge is expressed.

2. Expressing device according to claim 1, characterized by the fact that the separating device contains at least one cutting element for severing the wall of the inner tube.

3. Expressing device according to claim 2, characterized by the fact that the one or more cutting elements consist of an integrated or insertable plastic or metal blade.

4. Expressing device according to claim 2, characterized by the fact that the one or more cutting elements are arranged perpendicularly or obliquely to the wall of the inner tube.

5. Expressing device according to claim 2, characterized by the fact that the one or more cutting elements are arranged adjacent to a guide piece of an inner part of the expressing device that widens in the direction of at least one lateral outlet slot, wherein said guide piece fits into the inner tube.

6. Expressing device according to claim 5, characterized by the fact that the inner part widens continuously or in stages in the direction of the one or more outlet slots.

7. Expressing device according to claim 2, characterized by the fact that the one or more cutting elements are arranged on a connecting web between a cylindrical outer wall and the inner part.

8. Expressing device according to claim 1, characterized by the fact that the deflecting device has conical deflection surfaces and/or oblique guide surfaces in order to deflect the one or more severed sections of the inner tube to one or more lateral slots.

9. Expressing device according to claim 1, characterized by the fact that it has centering elements on its rear end that faces a pressure ram.

10. Expressing device according to claim 1, characterized by the fact that one or more additional deflectors are provided in the region of the separating device, wherein said additional deflectors press one end of the one or more severed sections of the inner tube inward and/or the other end outward.

11. Expressing device according to claim 10, characterized by the fact that the additional deflectors consist of a first deflector on one side of the separating device and a second deflector on the other side of the separating device.

12. Expressing device according to claim 5, characterized by the fact that the guide piece contains at least one recess for accommodating the inwardly pressed end of the one or more severed sections of the inner tube.

13. Expressing device according to claim 1, characterized by the fact that it is realized in the form of an integral injection-molded part.

14. Coaxial cartridge with an outer tube, an inner tube and an expressing device, characterized by the fact that the expressing device is realized in accordance with claim 1.

15. Coaxial cartridge according to claim 14, characterized by the fact that the inner tube contains at least one notch for attaching the separating device.

16. Coaxial cartridge according to claim 14, characterized by the fact that the expressing device is realized in the form of a separate part.

17. Coaxial cartridge according to claim 14, characterized by the fact that the expressing device is integrated into at least one sealing piston for sealing the outer tube and/or the inner tube.

18. Coaxial cartridge according to claim 14, characterized by the fact that the expressing device is pre-installed into the coaxial cartridge.

19. Coaxial cartridge according to claim 14, characterized by the fact that the inner tube is shortened, relative to the outer tube, by the length of the expressing device.

* * * * *